United States Patent [19]

Tomczak et al.

[11] 4,055,886

[45] Nov. 1, 1977

[54] VARIABLE INDUCTANCE TRANSDUCER COMBINED ASSEMBLY AND CALIBRATION METHOD

[75] Inventors: Lawrence William Tomczak, Sterling Heights; Frederick William Crall, Farmington; La Verne Andrew Caron, Sterling Heights; Walter Joseph Campau, Grosse Pointe Woods, all of Mich.

[73] Assignee: Chrysler Corporation, Highland Park, Mich.

[21] Appl. No.: 749,944

[22] Filed: Dec. 13, 1976

Related U.S. Application Data

[62] Division of Ser. No. 628,289, Nov. 3, 1975, Pat. No. 4,024,484.

[51] Int. Cl.[2] ..... H01F 41/00

[52] U.S. Cl. ..... 29/593; 29/606; 29/762

[58] Field of Search ..... 335/260, 278; 73/398 R, 73/406; 29/602, 606, 593, 762; 336/192, 83, 136, 30, 90, 92, 96

[56] References Cited

U.S. PATENT DOCUMENTS

| | | | |
|---|---|---|---|
| 2,656,520 | 10/1953 | Roessler, Jr. | 336/136 X |
| 3,308,411 | 3/1967 | Rushala | 73/398 R X |
| 3,621,547 | 11/1971 | Durham, Jr. | 29/593 X |

*Primary Examiner*—Carl E. Hall

*Attorney, Agent, or Firm*—Baldwin & Newtson

[57] ABSTRACT

A variable inductance transducer for providing, via inductance modulation, an electrical output signal which is representative of a mechanical input signal. In a preferred embodiment the mechanical input signal is the intake manifold vacuum of an internal combustion engine and the electrical output signal is utilized in an engine spark timing control system to adjust the spark timing in accordance with the intake manifold vacuum. The transducer comprises an actuating mechanism in the form of a vacuum servo which axially positions a ferrite core within a central axial bore of a plastic bobbin on which an inductive coil is wound to thereby vary the inductance of the coil in accordance with the vacuum applied to the servo. The bobbin and coil are enclosed in plastic to form a separate unit which is assembled into the transducer by being controllably lodged within the bore of a molded plastic element forming a portion of the body of the transducer. The transducer is calibrated by the controlled lodging of the unit within the bore of the molded plastic element.

2 Claims, 8 Drawing Figures

VARIABLE INDUCTANCE TRANSDUCER COMBINED ASSEMBLY AND CALIBRATION METHOD

This application is a division of application Ser. No. 628,289 filed Nov. 3, 1975, now U.S. Pat. No. 4,024,484.

BACKGROUND AND SUMMARY OF THE INVENTION

This invention relates to a varible inductance transducer which is adapted to be connected in an electrical circuit to provide via inductance modulation, an electrical output signal representative of a mechanical input signal. More specifically, the invention is directed toward a novel variable inductance transducer wherein the inductance is modulated by the pressure differential across a movable diaphragm contained within the transducer. The invention is particularly well suited for use in a control system for an internal combustion engine.

Among the objects of the present invention are to provide an improved varible inductance transducer which: is well suited for use in an automotive engine spark timing control system; achieves a degree of accuracy, repeatability, and response in such a system without imposing excessive cost penalties; is reasonably compact and rugged in construction; can be quickly and accurately calibrated; and exhibits other advatages over prior transducers of the same general type. These features and advatages, along with additional ones, will be seen in the ensuing description and claims which are to be taken in conjunction with the accompanying drawings.

BRIEF DESCRIPTION OF THE DRAWINGS

The drawings illustrate a preferred embodiment of the present invention according to the best mode presently contemplated in carrying out the invention.

CROSS REFERENCE TO RELATED APPLICATION

The present application is related to our earlier copending application entitled "Variable Inductance Transducers" filed Mar. 17, 1975 and having Ser. No. 559,204.

DESCRIPTION OF THE PREFERRED EMBODIMENT

Figure 1:
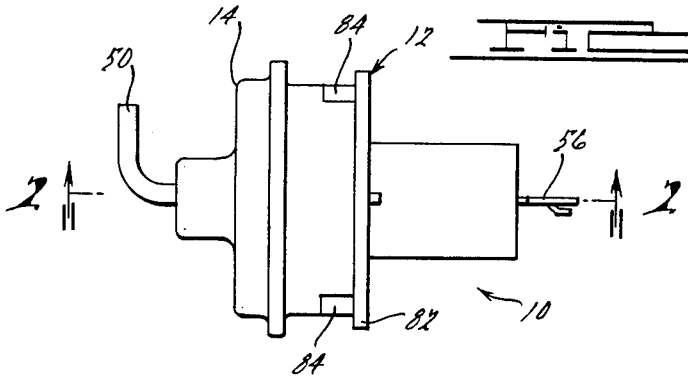
FIG. 1 is a plan view of a varible inductance transducer embodying principles of the present invention.
Figure 2:
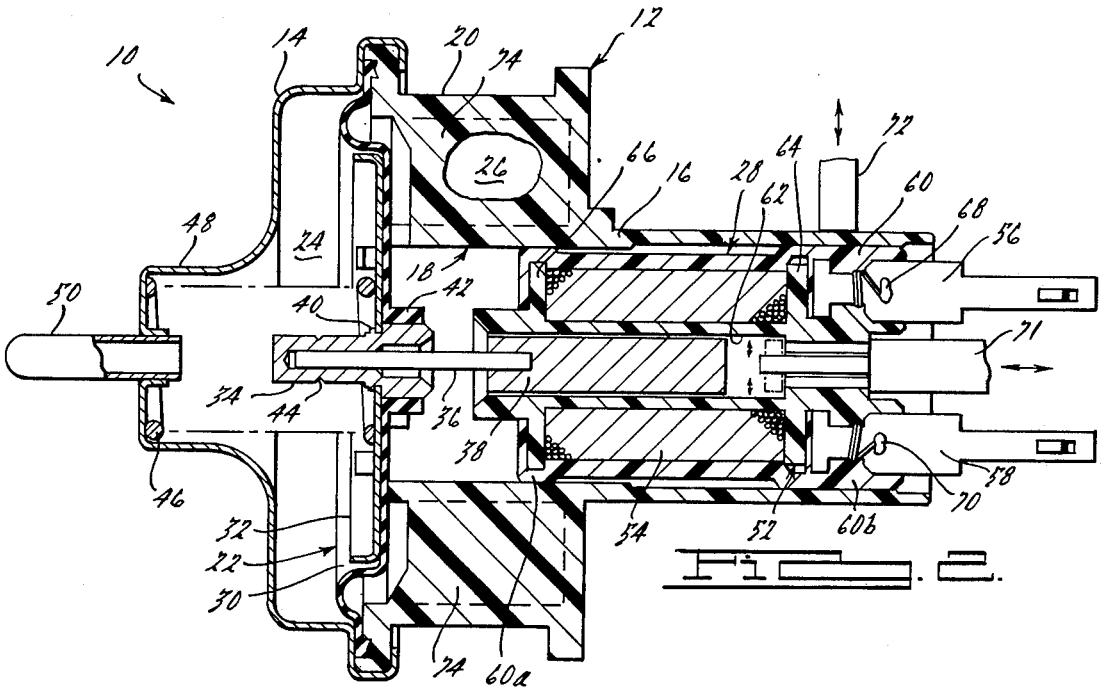
FIG. 2 is an enlarged longitudinal sectional view taken in the direction of arrows 2—2 in FIG. 1.
Figure 3:
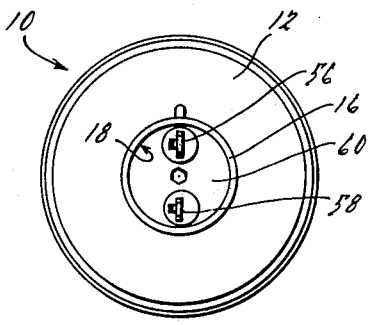
FIG. 3 is a right axial end view of the transducer of FIG. 1.

Turning first to FIGS. 1, 2 and 3, a variable inductance transducer 10 embodying principles of the present invention comprises a molded plastic element 12 and a metal shell 14 secured together to form the transducer body or housing. The molded plastic element 12 comprises a central main tubular section 16 having a generally cylindrical throughbore 18 extending axially of the transducer. Element 12 is further formed with a cup-like shell 20 disposed around the outside of the main tubular section 16 and open toward the left hand side of the drawing as viewed in FIG. 2. A diaphragm assembly, designated generally at 22, is mechanically held between the peripheries of shells 20 and 14 to define a vacuum chamber 24 on the left hand side of the diaphragm assembly and an atmospheric chamber 26 on the right hand side of the diaphragm assembly, as also viewed in FIG. 2. A separate coil unit, designated generally at 28, is lodged within bore 18 and is operatively coupled with diaphragm assembly 22.

Considered in greater detail, diaphragm assembly 22 comprises a resilient annular diaphragm 30, an annular metal support plate 32, a metal fitting 34, a flexible connecting element 36 and a ferrite core 38. The outer periphery of diaphragm 30 is provided with a bead which lodges within a suitable groove extending circumferentially around the periphery of shell 20. The bead is deformably lodged within this groove by the periphery of metal shell 14 being wrapped over and around the periphery of shell 20 to securely anchor and seal the periphery of the diaphragm and provide the atmospheric and vacuum chambers 26 and 24 respectively. Fitting 34 is centrally staked to support plate 32 as at 40 and the inner periphery of diaphragm 30 is formed into an axially projecting sealing lip 42 which seals against the right hand outer periphery of fitting 34. Fitting 34 is provided with a central bore open to atmospheric chamber 26. Connecting element 36 is inserted into the bore and the two are secured together by any suitable means, for example by crimping the fitting as at 44 to deformably engage connecting element 36. The other end of connecting element 36 is affixed to core 38 by any suitable means, for example, by providing a short bore in the left hand end of the core, inserting the right hand end of connecting element 36 into this bore and then joining the two by a suitable adhesive such as epoxy. A helically coiled compression spring 46 has its left hand end lodged within a suitable seat 48 fashioned in shell 14 andthe right hand end of the spring bears against support plate 32 so as to bias the diaphragm assembly axially toward the right as viewed in FIG. 2 into abutment with the left hand end of the main tubular section 16. A nipple 50 is inserted into and joined with the left hand end of shell 14 to provide a means via which the vacuum chamber 24 may be communicated to a source of vacuum.

Considered in greater detail, coil unit 28 comprises a molded plastic bobbin 52, an inductive coil 54, a pair of electrical terminals 56, 58 and a molded protective enclosure 60. Bobbin 52 has a tubular body including a cylindrical axial bore 62. A pair of annular, axially-spaced, imperforate end walls 64 and 66 are directed radially outwardly of the tubular body of the bobbin to form an annular coil receiving space around the body between themselves. The coil 54 is formed by winding a length of electrically conductive coil wire around the body of the bobbin to fill the annular coil receiving space between the two end walls 64 and 66. The right hand end of bobbin 52 includes a pair of electrical terminal receiving sockets for receiving the terminals 56 and 58. The socket-engaging portions of the two terminals are disposed in the sockets and the end segments of the length of wire forming coil 54 are brought out and wrapped around the two terminals and then electrically joined to the two terminals, for example by soldering as shown at 68 and 70. Enclosure 60 is molded around the bobbin to completely enclose coil 54 and to lock terminals 56 and 58 in their respective sockets. The enclosure is also molded into the shape of a protruberence around a portion of each terminal immediately adjacent its socket in order to more securely support the terminals which protrude a significant distance from the end of the bobbin. With the transducer completely assembled, core 38 is disposed within bore 62 for displacement axially thereof. While the core 38 is provided with a reasonably close fit within bore 62, there is sufficient clearance provided so that the atmospheric chamber 26 is communicated via bore 62 to atmosphere.

An important feature of the present invention relates to the manner by which coil unit 28 is assembled into bore 18. Hence consideration of greater detail of the design of bore 18 and enclosure 60 is in order.

Figure 6:
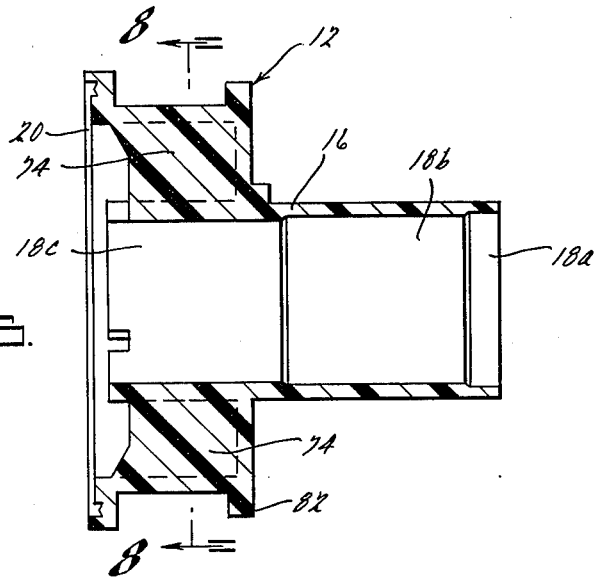
FIG. 6 is a longitudinal sectional view taken in the direction of arrows 6—6 in FIG. 5.
Figure 7:
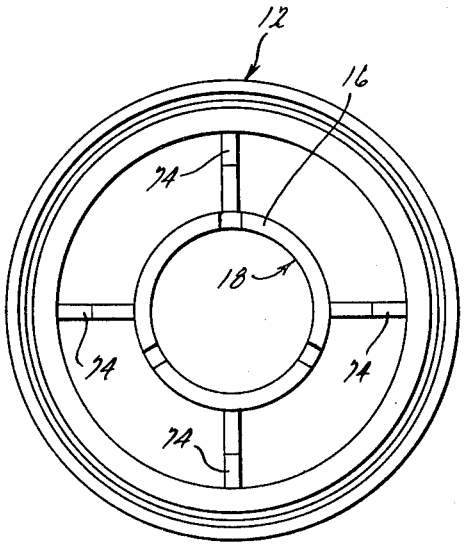
FIG. 7 is a left axial end view of the element of FIG. 5.
Figure 8:
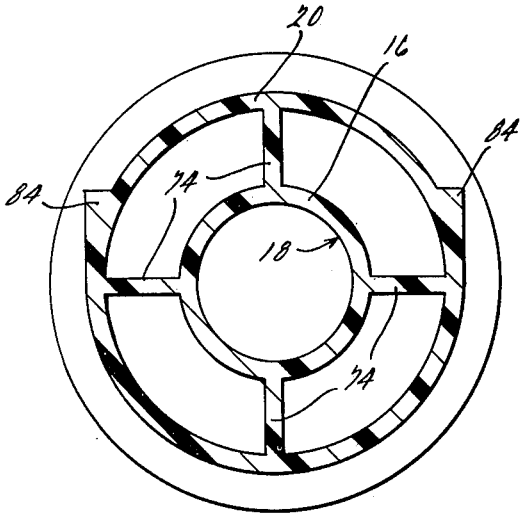
FIG. 8 is a transverse cross sectional view taken in the direction of arrows 8—8 in FIG. 6.

As perhaps best seen in FIG. 6, bore 18 is comprised of three sections each having a different diameter (neglecting draft due to molding of the part), the diameters of the sections decreasing in size from right to left as viewed in FIG. 6. For convenience, the right hand bore section is designated 18*a* and has the largest diameter, the intermediate section 18*b* is of slightly smaller diameter, and the section 18*c* is of still slightly smaller diameter. In FIG. 2 it will be observed that enclosure 60, which is preferably injection-molded around the coil and bobbin, is designed with a diametrically enlarged shoulder 60*a* at the left hand end thereof and a diametrically enlarged shoulder 60*b* at the right hand end thereof. The coil unit is designed to be assembled into the tubular section 16 via the open right hand end thereof, for example by being inserted by means of an insertion tool 71. Further, the diameter of shoulder 60*a* is chosen to permit the free insertion of the coil unit bore 18 until the shoulder 60*a* begins to be lodged within diameter 18*c.* The diameter of bore 18*c* is chosen to be slightly less than the diameter of shoulder 60*a* so that an interference fit occurs. Likewise, the diameter of shoulder 60*b* is chosen to permit the same to pass freely through bore section 18*a* until abutment thereof with bore section 18*b* occurs. The diameter of shoulder 60*b* is slightly greater than the diameter of bore portion 18*b* so that an interference fit exists. As the coil unit is assembled into bore 18, both interference fits are encountered simultaneously. Continued displacement of coil assembly 28 with respect to bore 18 lodges shoulder 60*a* within bore section 18*c* and shoulder 60*b* within section 18*b.* By making element 12 out of a slightly yieldable plastic material, for example, glass-filled nylon, the slight yielding of the material permits the coil assembly to be forced into the bore a controlled desired distance. The correct insertion distance can be obtained by creating a known pressure differential between the two chambers 24 and 26, and connecting terminals 56 and 58 in a suitable monitoring circuit, and then advancing the coil unit until a desired response is obtained in the monitoring circuit. If the coil unit is inserted too far into bore 18, the tool 71 is designed with a radially expandable mechanism which can be expanded (as shown in phantom) to grab the bobbin so that it can be withdrawn the necessary amount by the tool. It is desirable to join the coil and tubular section in the correct assembled relation, for example, by ultrasonic welding the two as indicated by a suitable tool 72 which is moved into engagement with the transducer to effect the union. During insertion, the provision of the chamfer at the left hand end of bore 62 in conjunction with the flexibility of connecting element 36 enables core 38 to be guided into bore 62 even if the two are not precisely axially aligned. It is preferable that connecting element 36 be inserted into bore 62 prior to encountering the press-fit engagement of the coil unit with the housing element.

The provision of the four radially directed ribs 74 90° apart between the outer wall of shell 20 and the main tubular section 16 serves to rigidify the latter so that limited controlled yielding of the tubular section is attained when the coil unit is inserted into bore 18. The left hand ends of ribs 74 as viewed in FIG. 2 stop short of the left hand end of the tubular section 16 so that partitioning of any of the sections of atmospheric chamber 26 between the ribs does not occur upon abutment of diaphragm assembly 22 with the end of tubular secion 16.

Figure 4:
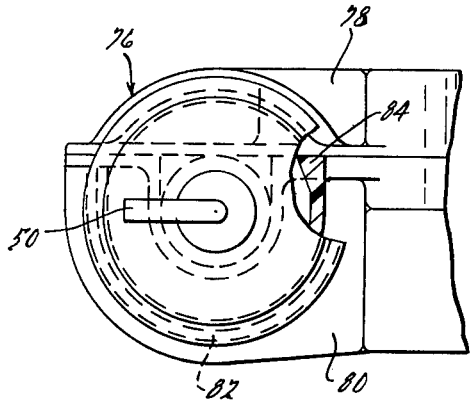
FIG. 4 is a left axial and view of the transducer of FIG. 1 but illustrating the mounting of the transducer within a housing.
Figure 5:
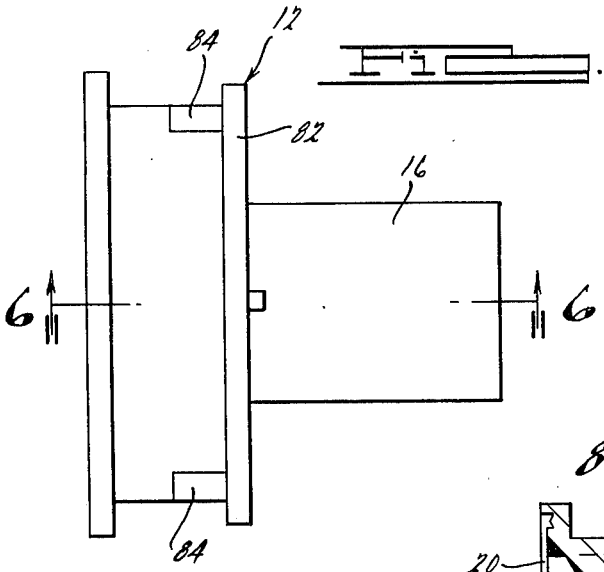
FIG. 5 is a enlarged plan view of one element of the transducer of FIG. 1 shown by itself.

FIG. 4 shows transducer 10 mounted within a two-piece housing 76 having mating upper and lower housing members 78 and 80, respectively. The two housing elements define a receptacle therein for the transducer. Housing element 12 is provided with a circular ridge 82 which lodges within a complementary groove extending circumferentially around the receptacle. Immediately axially adjacent ridge 82 on element 12 there are fashioned on the circular outer cylindrical wall of element 12, a pair of tabs 84. The housing receptacle is designed so that ridge 82 can be lodged within the lower housing member groove while tabs 84 circumferentially orient the transducer. When the upper housing element is assembled to the lower housing element, the transducer is securely contained on the housing.

In use the terminals 56 and 58 are electrically connected in a transducer circuit, for example of the type shown in U.S. application Ser. No. 559,203 filed Mar. 17, 1975 and assigned to the same assignee as the present application. Nipple 50 is connected to the intake manifold by means of a hose. As the manifold vacuum caries during engine operation, core 38 is positioned in accordance therewith to vary the inductance appearing between terminals 56 and 58. The transducer circuit in turn adjusts the engine spark timing.

What is claimed is:

1. The method of making a variable inductance vacuum transducer for accurate combined assembly and calibration to obtain a desired inductance vs. vacuum characteristic thereof, said method comprising:

providing a housing containing an axial throughbore, a vacuum servo actuator at one axial end of said throughbore, and a core disposed within said throughbore and connected with said servo actuator for positioning thereby axially within said throughbore in accordance with a vacuum signal applied to the servo actuator, said servo actuator including a diaphragm which is displaceable in accordance with said vacuum signal and connected with said core for similarly displacing the latter, said servo actuator also including a biasing spring for biasing said diaphragm and hence said core, said biasing spring being increasingly compressed as the intensity of said vacuum signal increases;

providing an inductance coil unit capable of being disposed within said throughbore and having an axial bore passing throuhg the coil thereof large enough to permit said core to move therein;

applying a given vacuum signal to said vacuum servo actuator to displace said diaphragm and core and also compress said biasing spring;

disposing said coil unit within said throughbore by first axially inserting the coil unit into said other axial end thereof and then more fully inserting the coil unit into said throughbore so that said core passes into said bore to a position which produces a desired inductance of said coil unit for the given vacuum signal applied to the servo actuator.

2. The method as claimed in claim 1 including joining said coil unit and said housing.

* * * * *